US005371978A

United States Patent [19]

Higashikawa

[11] Patent Number: 5,371,978

[45] Date of Patent: Dec. 13, 1994

[54] HONING TOOL AND SUPER PRECISION FINISHING METHOD USING THE SAME

[75] Inventor: Katsutoshi Higashikawa, Aichi, Japan

[73] Assignee: Toyo Co., Ltd., Aichi, Japan

[21] Appl. No.: 128,744

[22] Filed: Sep. 30, 1993

Related U.S. Application Data

[63] Continuation of Ser. No. 842,175, Apr. 2, 1992, abandoned.

[51] Int. Cl.[5] ..... B24B 9/02

[52] U.S. Cl. ..... 451/51; 451/478; 451/495; 451/504; 451/512; 451/155; 451/508

[58] Field of Search ..... 51/346, 338, 290, 39 H, 51/73 R, 21, 20, 245, 363, 372, 376, 380, 206 R, 206 P, 281 P

[56] References Cited

U.S. PATENT DOCUMENTS

| | | | |
|---|---|---|---|
| 2,777,257 | 1/1957 | Johnson | 51/346 |
| 3,710,518 | 1/1973 | Grosseau | 51/338 |
| 3,987,591 | 10/1976 | Czubak | 51/346 |
| 4,197,680 | 4/1980 | Althen | 51/343 |
| 4,424,648 | 1/1984 | Largeteau | 51/338 |
| 4,655,007 | 4/1987 | Graft | 51/338 |
| 5,022,196 | 6/1991 | Schimweg | 51/338 |
| 5,088,237 | 2/1992 | Nagel | 51/34 H |

FOREIGN PATENT DOCUMENTS

| | | |
|---|---|---|
| 54-74589 | 6/1979 | Japan . |
| 55-11756 | 1/1980 | Japan . |
| 56-30149 | 7/1981 | Japan . |
| 60-190559 | 12/1985 | Japan . |
| 61-288971 | 12/1986 | Japan . |

*Primary Examiner*—James G. Smith
*Assistant Examiner*—Eileen P. Morgan
*Attorney, Agent, or Firm*—Armstrong, Westerman, Hattori, McLeland & Naughton

[57] ABSTRACT

The invention relates to a honing tool for carrying out honing working of a work with high accuracy and super precision finishing method using the honing tool. The honing tool is mainly constituted by a pilot section (5), a rough grinding section (7), a finish grinding section (10) and a correction section (13). The honing tool is sent at rapid speed while being reciprocated little, and the machining working and correction finishing of the straightness are carried out thereby the honing working is carried out. According to the invention, the machining working efficiency and the working accuracy can be improved, and the honing finishing with high straightness becomes possible.

5 Claims, 5 Drawing Sheets

HONING TOOL AND SUPER PRECISION FINISHING METHOD USING THE SAME

This application is a continuation of application Ser. No. 07/842,175 filed Apr. 2, 1992, now abandoned.

TECHNICAL FIELD

The present invention relates to a honing tool for carrying out honing working of a work with high precision and super precision finishing method using the same.

BACKGROUND ART

In the prior art, when honing working is to be carried out, a tool with several grindstones attached on its periphery is used, and while the tool is supplied with rotational motion, it is moved in reciprocating motion by a distance corresponding to working area of the work thereby the grinding working is carried out.

One example of such a honing tool is shown in FIG. 1.

The honing tool 61 comprises a hollow mandrel 62, and a plurality of grindstones 66 being provided on the outer circumference of the top end portion 63 of the mandrel 62 and movable in the radial direction. The grindstones 66 are rotated while being pushed to the outside through a bed plate 67 by moving a taper part 65 of a mandrel shaft 64 up and down, and are reciprocated up and down repeatedly by the distance corresponding to the working area thereby the grinding working of a prescribed diameter is carried out.

In the honing working by such a honing tool 61, however, when it is reciprocated up and down repeatedly along a circumferential surface of a hole 81 of a work 80 as shown in FIG. 2, edge of lands 81*a* is liable to be unsharpened. Moreover, when the lands 81*a* are different in length, there is a problem that the shorter land 81*a* is machined more and the finished diameter becomes larger.

If the reciprocating speed is made larger in order to raise the working efficiency, loading or crushing of the grindstone 66 occurs and the efficiency is further decreased.

Therefore some honing tool is provided with two sets of grinding sections in order to raise the working efficiency, and can perform rough machining and finish machining continuously.

FIG. 3 shows a honing tool 71 in such constitution. The honing tool 71 is constituted by a cylindrical body 72, a main machining grinding section 73 being installed at the top end portion of the body 72 and comprising a rough grindstone, and a finish grinding section 74 being installed at the center portion and comprising a finish grindstone. A tapered adjusting rod 75 is fitted to the inside of the main machining grinding section 73 so that the main machining diameter can be adjusted, and a tapered adjusting rod 77 is fitted to the inside of the finish grinding section 74 so that the finish grinding diameter can be adjusted.

The honing tool 71 with the main machining diameter and the finish machining diameter being adjusted is rotated and moved by a distance corresponding to the working area thereby the grinding finishing of the prescribed diameter is carried out.

In such a honing tool 71, however, there is a problem that the honing tool 71 is liable to be rolled laterally with respect to the work thereby the straightness of the hole subjected to the grinding finishing cannot be held. Also when the moving speed of the tool is made larger, there is a problem that loading or crushing of the main machining grindstone 73 and the finish grindstone 74 occurs.

DISCLOSURE OF INVENTION

In order to solve the above-mentioned problems in the prior art, a honing tool and super precision finishing method using the same according to the present invention are constituted as follows.

The honing tool according to the present invention is one having a plurality of grinding sections in the vertical direction of the body, comprising a pilot section being installed at the top end portion of the body and capable of being fitted to a work; a rough grinding section being installed adjacent to the upper portion of the pilot section and capable of being elastically deformed in the radial direction; a finish grinding section being installed adjacent to the upper portion of the rough grinding section and capable of being elastically deformed in the radial direction; a correction section being installed adjacent to the upper portion of the finish grinding section and formed in diameter slightly less than the machining diameter of the finish grinding section and formed longer than the overall length of the work in the working axis direction; a taper hole being bored at least on the inside of the rough grinding section and the finish grinding section and opened widening towards the top end of the body; and an adjusting section being formed so as to be fitted to the taper hole and having at least two taper parts and capable of adjusting the machining diameter of the rough grinding section and the finish grinding section. The super precision finishing method according to the invention uses the honing tool, and comprises step of sending the honing tool at rapid speed while being reciprocated slightly over a distance corresponding to the working length of the work; step of fitting the pilot section to the work and supporting the top end portion of the honing tool rotatably; step of machining the work by the rough grinding section and the finish grinding section; and step of pushing the correction section to the circumferential surface of the work and performing the correction finishing of the straightness of the work.

BEST MODE FOR CARRYING OUT THE INVENTION

Figure 1:
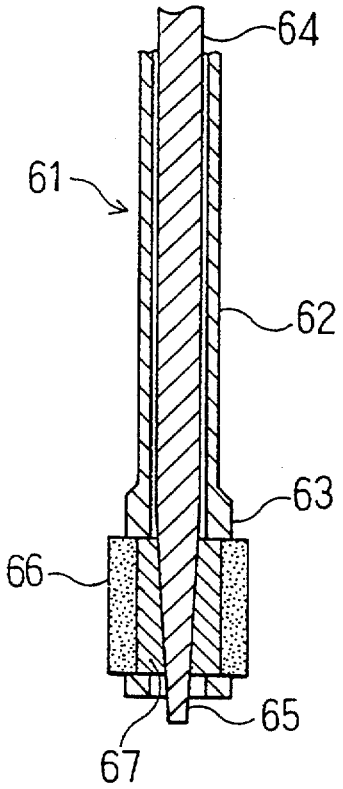
Fig. 1 PRIOR ART
FIG. 1 is a sectional view showing an example of a honing tool in the prior art where machining is carried out by enlarging diameter by a shaft having a taper part.
Figure 3:
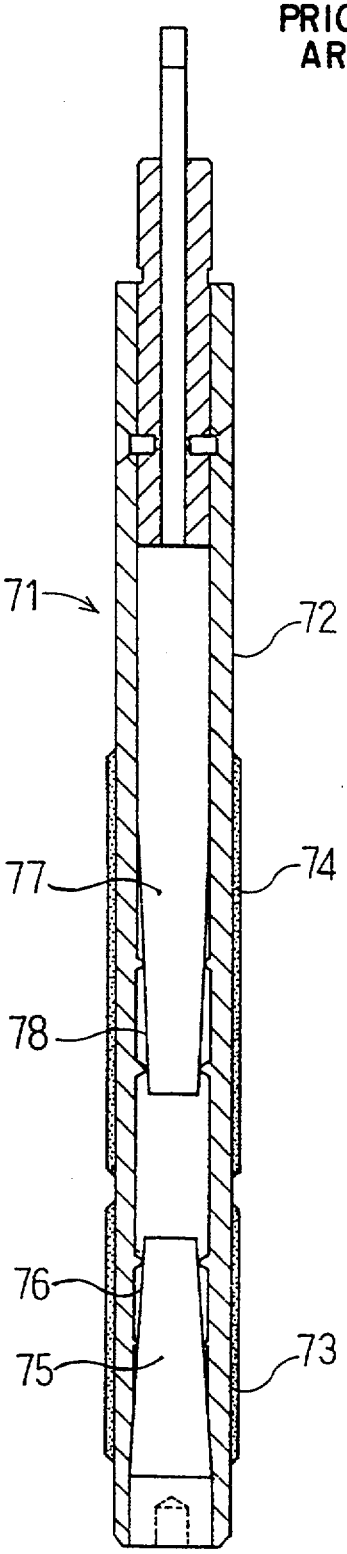
Fig. 3 PRIOR ART
FIG. 3 is a sectional view showing an example of a honing tool having two sets of grinding sections in the prior art.
Figure 2:
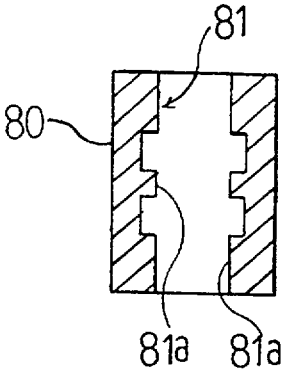
FIG. 2 is a sectional view showing an example of a work.
Figure 4:
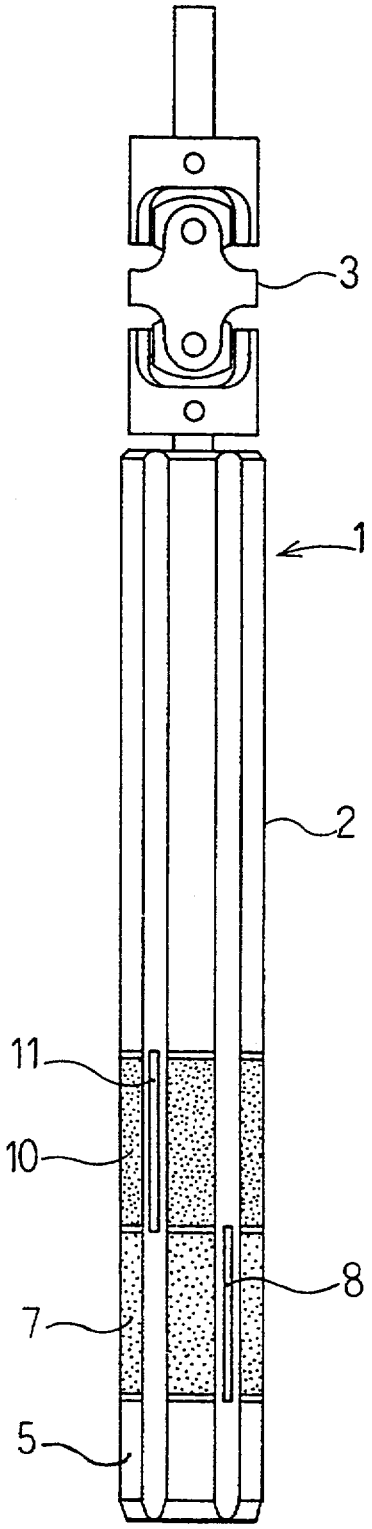
FIG. 4 is an outside view showing an embodiment of a honing tool of the invention.
Figure 5:
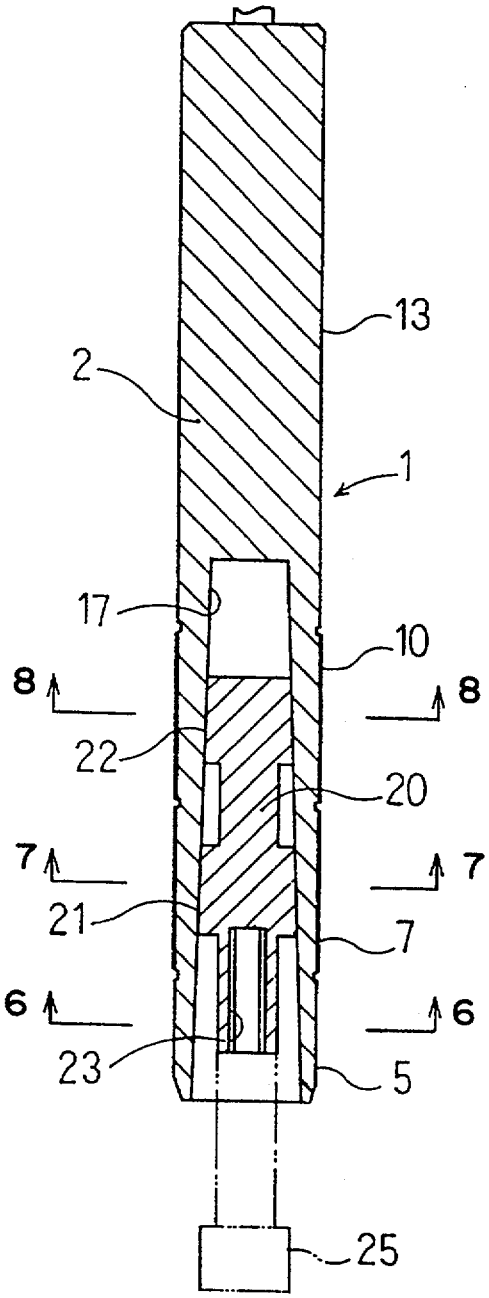
FIG. 5 is a longitudinal sectional view of the honing tool.
Figure 8:
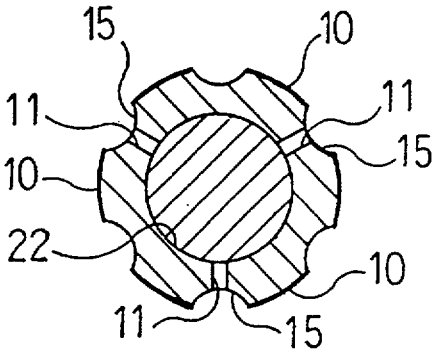
FIG. 8 is a sectional view taken in arrow C in FIG. 5.
Figure 7:
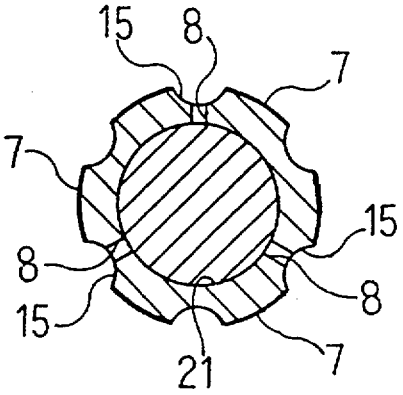
FIG. 7 is a sectional view taken in arrow B in FIG. 5.
Figure 6:
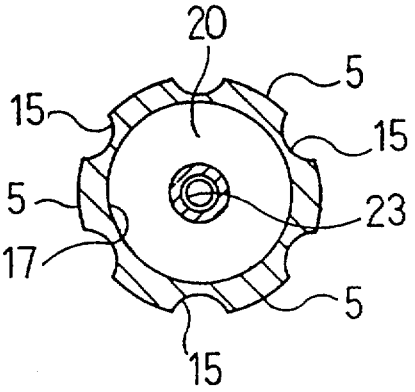
FIG. 6 is a sectional view taken in arrow A in FIG. 5.
Figure 9:
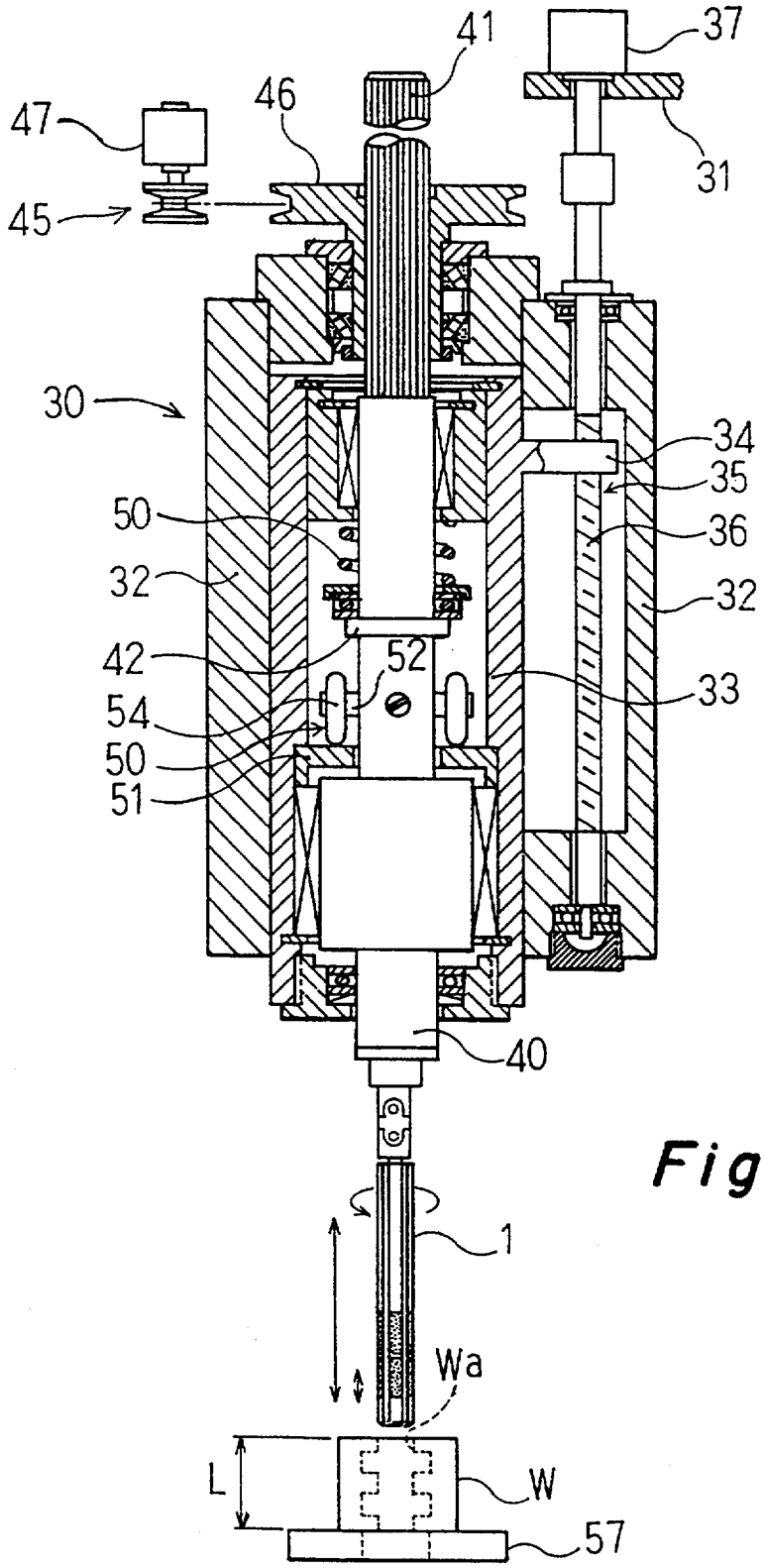
FIG. 9 is a schematic sectional view showing an example of a honing machine suitable for super precision finishing method of the invention.
Figure 10:
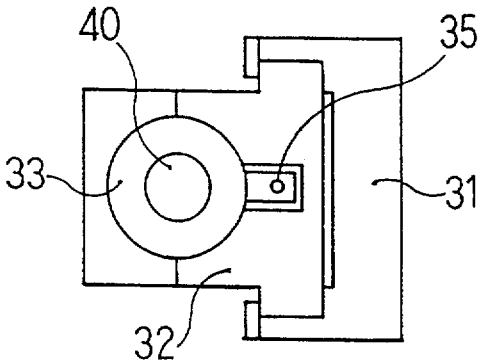
FIG. 10 is a plan view of the honing machine.
Figure 11:
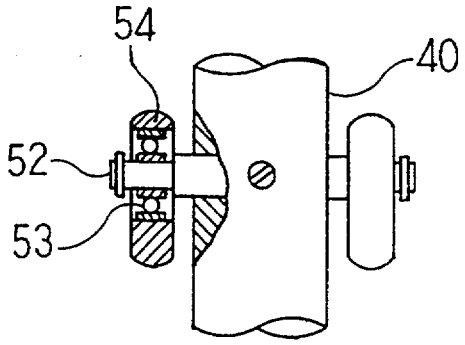
FIG. 11 is an enlarged sectional view of a small vertical reciprocating device of the invention.
Figure 12:
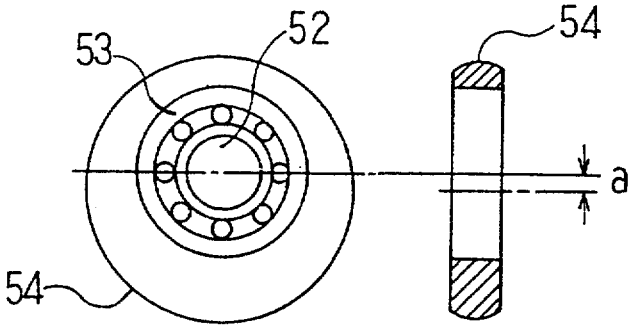
FIG. 12 is an explanation diagram showing eccentricity of an eccentric tire of the invention.

A honing tool 1 shown in FIG. 4 and FIG. 5 is mainly constituted by a body 2 provided with a pilot section 5, a rough grinding section 7, a finish grinding section 10, a correction section 13 and a taper hole 17, a Joint section 3 of universal joint type installed on the upper end portion of the body 2, and an adjustment section 20 capable of being fitted in the taper hole 17.

The body 2 is constituted by a rod member, and its outer circumference is provided with a plurality of oil grooves continuing from the pilot section 5 to the correction section 13.

The pilot section 5 is installed on the outer circumference at the top end portion of the body, and is constituted in the divided state in the circumferential direction by the oil grooves 15 in the embodiment. The outer diameter of the pilot section 5 is made slightly smaller than the hole diameter of the work before the grinding finishing.

The rough grinding section 7 is installed adjacent to the upper portion of the pilot body 5, and is divided in the circumferential direction by the oil grooves 15.

In the rough grinding section 7, grains with rough grading are electrodeposited so as to provide large grinding amount, and its outer diameter is formed larger than the outer diameter of the pilot section 5 and slightly smaller than that of the finishing diameter of the work. Also the oil grooves of the rough grinding section are provided with a plurality of slits 8 extending in the longitudinal direction and penetrating the taper hole 17.

The finish grinding section 10 is installed adjacent to the upper portion of the rough grinding section 7 and divided in the circumferential direction by the oil grooves 15. In the final grinding section 10, grains with fine grading suitable for the honing finishing are equal to the finish diameter of the work.

The rough grinding section 7 and the finish grinding section 10 may be formed also in that a grindstone of plate shape having grading suitable for each grinding section is stuck thereon.

The oil grooves 15 of the finish grinding section 10 are provided with a plurality of slits 11 extending in the longitudinal direction and penetrating the taper hole 17. The slits 11 are provided on oil grooves adjacent to the oil grooves 15 having the slits 8 formed thereon, and the slits 11 and the slits 8 are formed to be positioned alternately with each other in the circumferential direction of the body 2. In this case, the slits 8 and 11 are those to promote the elastic deformation of the rough grinding section 7 and the finish grinding section 10 in the radial direction respectively.

A correction section 13 is installed adjacent to the upper portion of the finish grinding section 10 and divided in the circumferential direction by the oil grooves 15. Outer diameter of the correction section 13 is formed slightly smaller than the finish diameter of the work, and it is formed longer than the overall length of the work in the working axis direction.

The taper hole 17 is bored at the inside of the rough grinding section 7 and the finish grinding section 10 having the axial line commonly, and it is opened widening towards the top end of the body 2 (lower side of FIG. 4).

An adjustment section 20 is constituted by a rod member capable of being fitted to the taper hole 17, and has a first taper portion 21 and a second taper portion 22 projecting in the radial direction in the embodiment and a thread portion 23 is formed in axial line shape.

The first taper portion 21 abuts on the wall surface of the taper hole 17 at the inside of the rough grinding section 7, and the second taper portion 22 abuts on the wall surface of the taper hole 17 at the inside of the finish grinding section 10, and both are constituted having the taper in similar manner to the taper hole 17 respectively.

An adjustment bolt 25 is threadedly engaged with the thread portion 23 of the adjustment section 20, and when the adjustment section 20 is strongly pushed into the taper hole 17, each of the first and second taper portions 21, 22 pushes the wall surface of the taper hole 17 and the rough grinding section 7 and the finish grinding section 10 are subjected to the elastic deformation and each machining diameter can be enlarged and adjusted simultaneously. The adjustment bolt 25 is pulled from that state, thereby the adjustment section 20 moves the taper hole 17 to the open side. Thereby the pushing pressure of the wall surface of the taper hole 17 by the first and second taper portions 21, 22 is decreased, and the rough grinding section 7 and the finish grinding section 10 are restored in the diameter reducing direction by elasticity of the body 2 itself constituting the base part and each machining diameter is decreased simultaneously.

In the honing tool 1 constituted in this manner, the joint section 3 is mounted on the main shaft of the honing machine thereby the honing working is carried out.

In the embodiment, although the grinding section is constituted in two stages, the rough grinding section 7 and the finish grinding section 10, it may be constituted in three or more stages further including an intermediate finish grinding section.

Next, super precision finishing method using a honing tool of the present invention will be described.

First, an example of a honing machine suitable for the method of the invention will be described using FIGS. 9 to 12.

The honing machine 30 comprises a column 31, a headstock 32 being supported by the column 31 and movable up and down, a spindle head 33 being supported by the headstock 32 and movable up and down, a main spindle 40 being rotatably installed in the spindle head 33 and detachably mounting a honing tool 1 at the bottom end portion, a driving gear 45 for driving the main spindle 40 and rotating the honing tool 1, a large reciprocating device 35 for reciprocating the spindle head 33 in the axial line direction of the main spindle 40 and moving the honing tool 1 up and down throughout a distance corresponding to a working length L of a work W (overall length of a hole Wa in the axial direction), and a small reciprocating device 50 for carrying out up-and-down motion at rapid speed, the distance corresponding to the working length L being made the upper limit of amplitude, and for reciprocating the honing tool 1 up and down at small amount through the main spindle 40, where the large or small reciprocating motion is superposed on the rotational motion of the honing tool 1.

The driving gear 45 of the honing machine 30 is constituted to drive a pulley 46 being spline-fitted to a spline 41 at the top end portion of the main spindle 40 by a rotary drive source 47.

The large reciprocating device 35 comprises an arm 34 projected from the spindle head 33 and having a female screw portion, a ball screw 36 being pivotally supported by the headstock 32 and threadedly engaged with the female screw portion of the arm 34, and a drive source 37 rotating and driving the ball screw 36. By the forward or reverse rotation of the ball screw 36, at the state that the spindle head 33 pivotally supports the main spindle 40, it is reciprocated up and down at large amount.

The small reciprocating device 50 comprises a circular ring washer 51 having a flat surface orthogonal to the axial line of the main spindle 40 and projected at the inside of the spindle head 33, a pin 52 fixed orthogonal to the main spindle 40, an eccentric tire 54 being pivotally supported on both ends of the pin 52 and rollable on the circular ring washer 51, and a spring 55 for biasing the main spindle 40 in one direction through a flange portion 42 of the main spindle 40. The eccentric tire 54 has cross section in contraction shape and is pivotally supported by the pin 52 through a ball bearing 53.

In the small reciprocating device 50, the eccentric tire 54 is rolled on the circular ring washer 51 accompanying with rotation of the main spindle 40. By this rolling motion, the main spindle 40 is formed to be reciprocated up and down little by amplitude being two times of the eccentricity amount "a" between the axial line of the pin 52 and the axial line of the eccentric tire 54 with respect to the spindle head 33 per one revolution.

The small reciprocating device 50 may be constituted in that the circular ring washer 51 is formed in one cam shape and the eccentric tire 54 is replaced by a concentric tire. It may be also constituted in that the main spindle 40 is reciprocated up and down little by a crank shaft mounted on the rotational drive source.

Next, super precision finishing method by the honing tool 1 using such a honing machine 30 will be described.

First, diameter of the pilot section 5, the rough grinding section 7, the finish grinding section 10 and the correction section 13 of the honing tool 1 is set corresponding to the diameter of the hole Wa of the work W. Particularly, the machining diameter of the rough grinding section 7 and the finish grinding section 10 is adjusted by the fitting degree of the adjustment section 20 to the taper hole 17. And then the honing tool 1 is mounted on the main spindle 40 of the honing machine 30. Also in the work W, the axial line of the hole Wa is made coincident with the axial line of the main spindle 40, and it is fixed to a table chuck 57 of the honing machine 30 below the honing tool 1.

If the driving gear 45 of the honing machine 30 is driven, the main spindle 40 is rotated and the honing tool 1 is rotated at a prescribed rotational speed. At the same time, the small reciprocating device 50 operates and the main spindle 40 is moved up and down with the amplitude *2a* at period corresponding to the rotational speed, and accompanying with this, the honing tool 1 is reciprocated up and down little.

Next, if the large reciprocating device 35 is driven, the spindle head 33 is moved downward, and accompanying with this, the main spindle 40 is moved downward.

The motion of the main spindle 40 is forward motion of the large reciprocating motion, and while the honing tool 1 is rotated, the small reciprocating motion and the large reciprocating motion are superposed, and the honing tool 1 is moved downward into the hole Wa.

Figure 13:
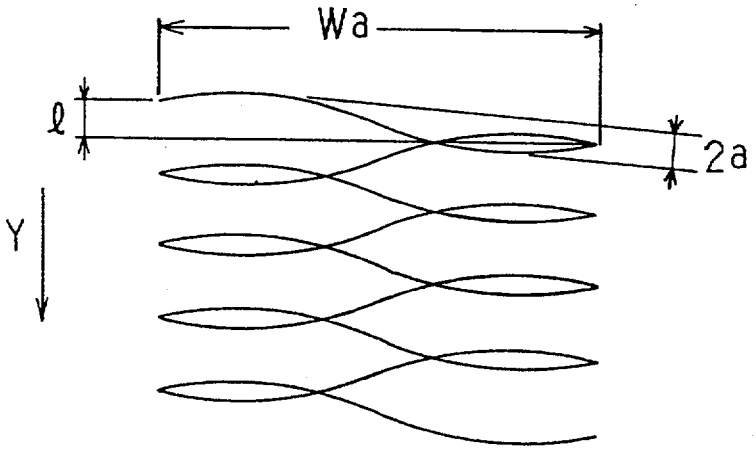
FIG. 13 is a curved line diagram explaining locus of the honing tool with respect to the work.

FIG. 13 is a curved line diagram explaining locus of the outer circumference of the honing tool 1 which is moved downward while being reciprocated little.

As shown in the figure, the honing tool 1 generates sine curve of the amplitude *2a* up and down per one revolution, and is moved downward by the moving amount l by means of the large reciprocating device 35.

One sine curve being one round of the inner circumference of the hole Wa continues to next sine curve, and the sine curve is generated in sequence and moved downward in the arrow Y direction.

By this downward motion, the pilot section 5 of the honing tool 1 is first moved in the hole Wa, and it is fitted to the hole Wa and rotates and supports the honing tool 1. Thereby advance of the honing tool 1 is guided straight and lateral rolling thereof is prevented.

Further if the downward motion advances, the rough grinding section 7 is moved in the hole Wa, and while the small reciprocating motion at the rapid speed and short amplitude is repeated, the downward motion at slow speed is continued by the large reciprocating device 35. Then the rough grinding section 7 carries out the heavy machining and forms the grounding for the finishing.

Continuing to the machining by the rough grinding section 7, the finish grinding section 10 is moved in the hole Wa and carries out the finish grinding working while repeating the small reciprocating motion. Further if the downward motion advances, the correction section 13 is moved in the hole Wa. The correction section 13 is opposite to the hole Wa machined to the prescribed finish diameter by the finish grinding section 10 throughout the overall length of the working length L. When the hole Wa is slightly curved in the axial direction, the portion is pushed by the correction section 13 and is made flat thereby the straight degree of the hole Wa is improved.

On the other hand, in each process as above described, lubricating oil is supplied through the oil groove 15 to the machining section, thereby seizure is prevented and the machining property is improved.

When the correction process is completed, the large reciprocating device 35 is reversely rotated and driven and the honing tool 1 is raised and pulled out of the hole Wa.

Thus the honing tool 1 is moved throughout the overall length of the working length L while repeating the small reciprocating motion, and the heavy machining and the finish machining and correction of the straight degree are carried out by the downward motion of one time thereby the work W can be finished with accuracy of super precision.

According to the honing tool of the present invention and the super precision finishing method using the honing tool as above described, since the large reciprocating motion and the small reciprocating motion are superposed on the honing tool, and the heavy machining by the rough grinding section and the finish machining by the finish grinding section are carried out continuously, the honing working with high precision can be carried out. Moreover, as the honing finishing can be carried out by only one passing of the honing tool along the work, the working efficiency can be significantly improved.

Also as the honing tool can be prevented from being rolled and can be inserted straight by the fitting between the pilot section and the work, the working accuracy can be improved and the edge can be prevented from being unsharpened.

Further, as the machined work is pushed by the correction section and the finishing is carried out, the honing finishing can be carried out with high straight degree.

Also as the moving machining working is carried out while repeating the small reciprocating motion, loading or crushing of each grinding section can be prevented.

What is claimed is:

1. A honing tool having a plurality of axially aligned grinding sections spaced along a longitudinal axis of a body, comprising:

a pilot section at an end of said body for guiding said tool into a work piece;

a rough grinding section axially aligned with said pilot section and adjacent to an upper end of said pilot section and elastically deformable in a radial direction;

a finish grinding section axially aligned with said rough grinding and said pilot sections and adjacent to an upper end of said rough grinding section and elastically deformable in said radial direction;

a correction section axially aligned with said finish grinding, rough grinding and pilot sections and adjacent an upper end of said finish grinding section and formed in diameter slightly less than a machining diameter of said finish grinding section and formed longer than an overall length of work;

a taper hole on an inside of said body and extending through said pilot section, said rough grinding section and said finish grinding section, said taper hole progressively narrowing from said pilot section through said finish grinding section; and an adjusting section fitted into said taper hole and having at least two taper parts, one part axially spaced from the other and each of said taper parts progressively narrowing along said longitudinal axis from said pilot section through said finish grinding section add cooperating with said taper hole for elastically radially expanding a machining diameter of said rough grinding section and said finish grinding section as said adjusting section is moved axially in a first direction in said hole in said body in a direction from said pilot section toward said finish grinding section, said rough grinding section and said finish grinding section contracting when said adjusting section is moved in a second direction opposite to said first direction and out of contact with said grinding sections.

2. A honing tool as set forth in claim 1, wherein a universal joint is installed at a base end portion of said body.

3. A honing tool as set forth in claim 1, wherein a plurality of oil grooves extend from the top end portion of said body to a base end portion thereof.

4. A honing tool as set forth in claim 1, wherein said rough grinding section and said finish grinding section are provided with slits for promoting elastic deformation in each radial direction.

5. A honing tool as set forth in claim 4, wherein said slits of said rough grinding section and said slits of said finish grinding section are alternated with each other in a circumferential direction of said body.

* * * * *